United States Patent [19]

Taub

[11] Patent Number: 4,739,921

[45] Date of Patent: Apr. 26, 1988

[54] STORAGE BOX WITH TRAY

[76] Inventor: Clifford Taub, 52 Brighton Ter., Wayne, N.J. 07470

[21] Appl. No.: 40,042

[22] Filed: Apr. 13, 1987

[51] Int. Cl.[4] ..... B65D 5/48

[52] U.S. Cl. ..... 229/120.32; 229/170; 229/174; 229/918

[58] Field of Search ..... 229/15, 27, 42, 174, 229/179, 918, DIG. 11, 170, 176

[56] References Cited

U.S. PATENT DOCUMENTS

| | | | |
|---|---|---|---|
| 1,857,033 | 5/1932 | Sherman | 229/15 |
| 1,981,187 | 11/1934 | Nuckols | 229/170 |
| 2,339,445 | 1/1944 | Wynne et al. | 229/176 |
| 2,758,774 | 8/1956 | Grunert et al. | 229/904 |
| 2,949,222 | 8/1960 | Coe | 229/41 R |
| 2,990,995 | 7/1961 | Wessel | 229/176 |
| 3,487,479 | 1/1970 | Grooms | 229/15 |
| 3,917,156 | 11/1975 | Baudet | 229/DIG. 11 |
| 4,530,459 | 7/1985 | Maroszek | 229/15 |

FOREIGN PATENT DOCUMENTS

| | | | |
|---|---|---|---|
| 189811 | 6/1964 | Denmark | 229/DIG. 11 |
| 2242872 | 3/1975 | France | 229/DIG. 11 |
| 2043596 | 10/1980 | United Kingdom | 229/DIG. 11 |
| 1579535 | 11/1980 | United Kingdom | 229/DIG. 11 |

*Primary Examiner*—Stephen Marcus
*Assistant Examiner*—Gary E. Elkins
*Attorney, Agent, or Firm*—Samuelson & Jacob

[57] ABSTRACT

A storage box has a container body erected from a unitary, flat blank to provide side walls, end walls, a closed bottom, an open top and cleats extending along the side walls for supporting a removable tray within the container body, between the closed bottom and the open top, the tray being movable along the cleats, relative to the end walls, for selective access to the contents of the box beneath the tray, and a cover for closing the open top of the container body.

23 Claims, 6 Drawing Sheets

STORAGE BOX WITH TRAY

The present invention relates generally to containers and boxes used primarily for storage and pertains, more specifically, to a storage box of the type having a container body with a separate tray supported in the container body, the container body being erected from a blank of sheet material.

Storage boxes of the type having a separate tray supported within the body of the box have been recognized as being highly effective in the efficient storage of a wide variety of items. Such boxes usually differ from ordinary rectangular storage boxes by the addition of cleats which are employed to support a tray for the storage of smaller items adjacent the top of the box, the tray being selectively removable for access to the storage space beneath the tray, usually for larger stored items. Over the years, economical storage boxes have been developed which are constructed of relatively inexpensive sheet materials, such a corrugated paperboard, and are supplied in blank, or knock-down, configuration for ease of transportation and inventory, and are erected readily into fully-serviceable units. The present invention provides a storage box of the type having a separable tray, in a construction readily erected from a blank, or knock-down, configurastion.

Accordingly, the present invention provides a storage box of the type having a separate tray supported within the container body of the box, and having several objects and advantages, some of which are: Simplicity of construction and erection so as to enable ease of manufacture and use; utilization of a minimum number of component parts, all of which are stored readily in a flat configuration for economical packaging, transportation and inventory storage; maximum strength and integrity with minimum complexity in the component parts and in the fully-erected configuration, for widespread use and a long service life; aesthetic appeal for increasing the variety of uses; and economical construction in large numbers of consistent high quality.

The above objects and advantages, as well as further objects and advantages, are attained by the present invention which may be described briefly as providing, in a storage box of the type having a container body with a closed bottom, an open top, opposite longitudinally-extending side walls and opposite laterally-extending end walls, the side walls and end walls extending upwardly from the closed bottom to the open top, and a removable tray supported upon support surfaces located on cleats placed within the container body between the bottom and the top thereof, the improvement in which the container body is erected from a blank of sheet material, such as corrugated paperboard, the blank having longitudinally opposite end boundaries and laterally opposite side boundaries, the blank comprising: a bottom section bounded by laterally opposite side fold-lines and longitudinally opposite end fold-lines; opposite side sections between the side boundaries and the opposite side fold-lines for folding along the side fold-lines to establish the upwardly-extending opposite side walls; opposite end sections between the end boundaries and the opposite end fold-lines for folding along the end fold-lines to establish the upwardly-extending opposite end walls, the end sections each having side edges for juxtaposition with corresponding side walls upon erection of the side walls and the end walls; cleat sections at the side edges of the end sections for establishing the cleats and placing the cleats in positions wherein the cleats extend longitudinally along corresponding side walls upon erection of the side walls, the end walls and the cleats; and a support surface portion in each cleat section for establishing a corresponding support surface and placing the support surface in position wherein the support surface extends longitudinally along a corresponding side wall from the intersection of that side wall with a corresponding end wall toward the opposite end wall, the support surfaces being located between the closed bottom and the open top for supporting the tray thereon, upon erection of the container body. In the illustrated embodiments of the invention, the tray has a longitudinal length less than the longitudinal distance between the opposite end walls of the container body and each support portion has a longitudinal length greater than the difference between the length of the tray and the distance between the opposite end walls such that the tray selectively may be displaced in longitudinal directions relative to end walls while supported upon all of the support surfaces of the erected cleats in the erected container body.

The invention will be understood more fully, while still further objects and advantages will become apparent, in the following detailed description of preferred embodiments of the invention illustrated in the accompanying drawing, in which.

Figure 1:
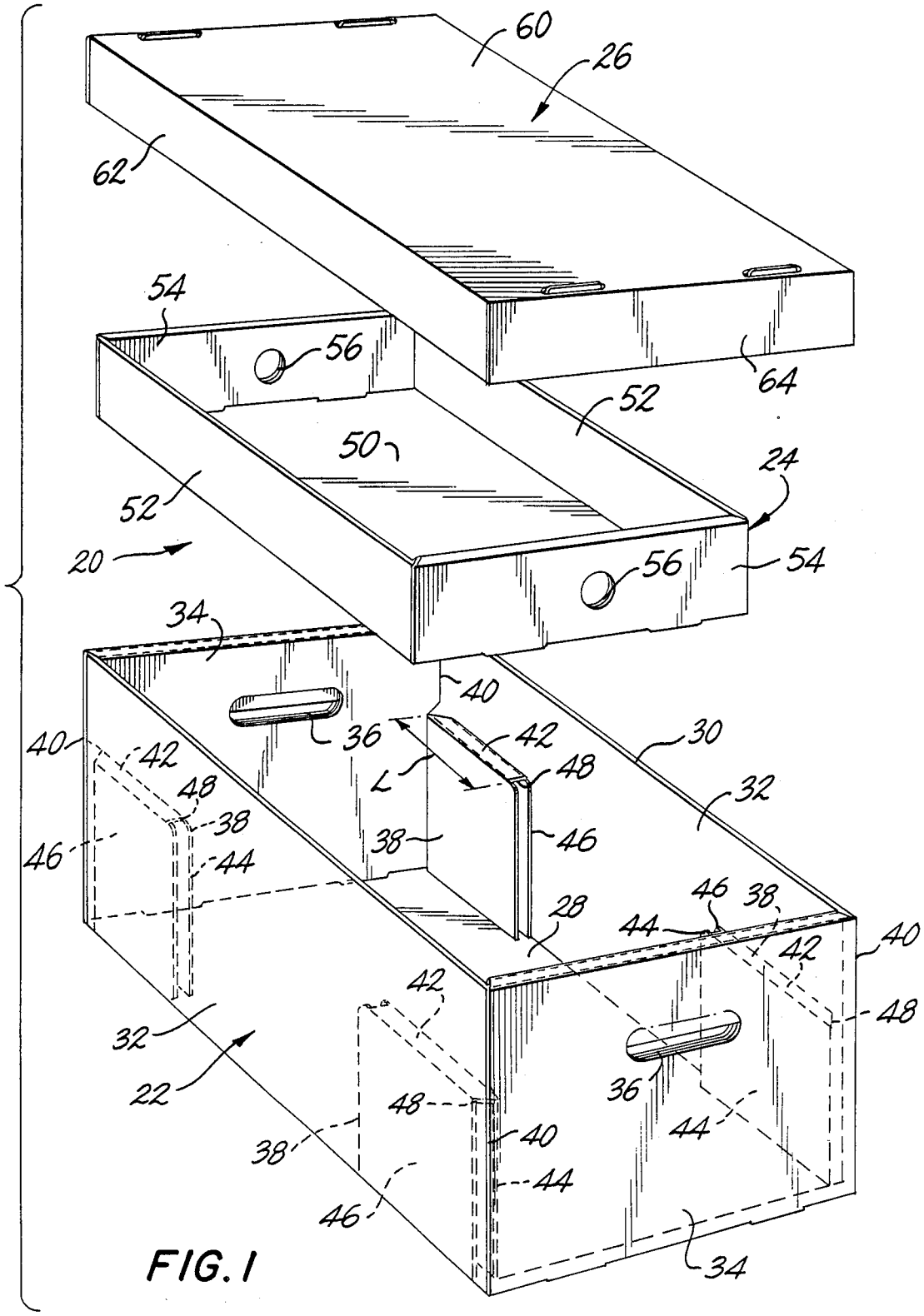
FIG. 1 is an exploded perspective view of a storage box, including a tray and a cover, constructed in accordance with the invention.

Referring now to the drawing, and especially to FIG. 1 thereof, a storage box constructed in accordance with the present invention is shown at 20 and is seen to include a container body 22, a tray 24 and a cover 26. Container body 22 has a closed bottom 28, an open top 30, longitudinally-extending side walls 32 and laterally-extending end walls 34, the side walls 32 and end walls 34 extending upwardly from the closed bottom 28 to the open top 30. Handhold apertures 36 are placed in end walls 34 to provide for the lifting and carrying of storage box 20, in a manner now well-known in storage boxes.

Figure 2:
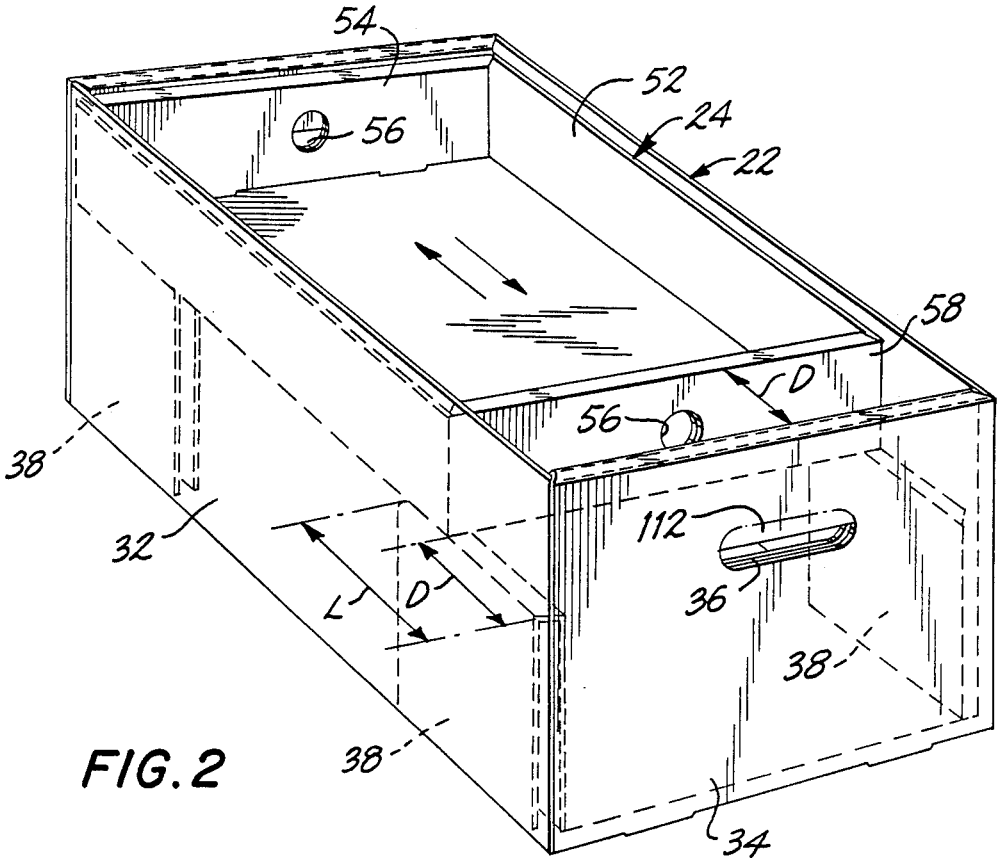
FIG. 2 is an perspective view of the container body of the box with the tray in place therein.

A cleat 38 extends along each side wall 32, within the interior of the container body 22, from each corner 40 established at the intersection of a side wall 32 with an end wall 34, each cleat 38 extending from one corner 40 toward the opposite corner 40 formed by the side wall 32 along which the cleat 38 runs. The cleats 38 provide horizontal support surfaces 42 upon which the tray 24 is to be supported, as shown in FIG. 2. Firm support for the tray 24 is provided by the construction of each cleat 38, which construction includes a pair of support walls, including inner support wall 44 and outer support wall 46, depending from a horizontal ledge 48 upon which lies the support surface 42. Support walls 44 and 46 are essentially parallel to one another, establishing an inverted, generally U-shaped configuration in each cleat 38, which inverted U-shaped configuration rests upon the bottom 28 of the container body 22 to provide a rigid support structure for tray 24.

Tray 24 includes a bottom 50, upstanding side walls 52 and upstanding end walls 54, the side walls 52 extending longitudinally between the laterally-extending end walls 54. Finger-lift apertures 56 are provided in each end wall 54 for selectively lowering the tray 24 onto the cleats 38 or lifting the tray 24 from the cleats 38. The dimensions of tray 24 enable the tray 24 to be received within the container body 22 for resting upon the cleats 38. As best seen in FIG. 2, tray 24 is shorter than container body 22, the side walls 52 of tray 24 being shorter than the side walls 32 of the container body 22, so that a gap 58 is available between an end wall 54 of the tray 24 and a corresponding end wall 34 of the container body 22 for access to the storage space in the container body 22 beneath the tray 24. The tray 24 may be displaced in longitudinal directions relative to the container body 22, by sliding the tray 24 along the cleats 38 in the directions indicated by the arrows in FIG. 2, to open a gap 58 adjacent either end wall 34 for access to the space beneath the tray 24 without removal of the tray from the container body 22. In order to assure that the tray 24 cannot be slid off the support surfaces 42 provided by the cleats 38, the support surfaces 42 each have a length L (also see FIG. 1) which is at least greater than the length of the gap 58, that is, greater than the difference D between the longitudinal length of the container body 22 and the longitudinal length of the tray 24.

The cover 26 has a top 60, depending side skirts 62 and depending end skirts 64, the side skirts 62 extending longitudinally between the laterally-extending end skirts 64. The relative dimensions of the cover 26 and the container body 22 are such that the cover 26 is selectively telescoped over the open top 30 of the container body 22 to close the storage box 20.

Figure 3:
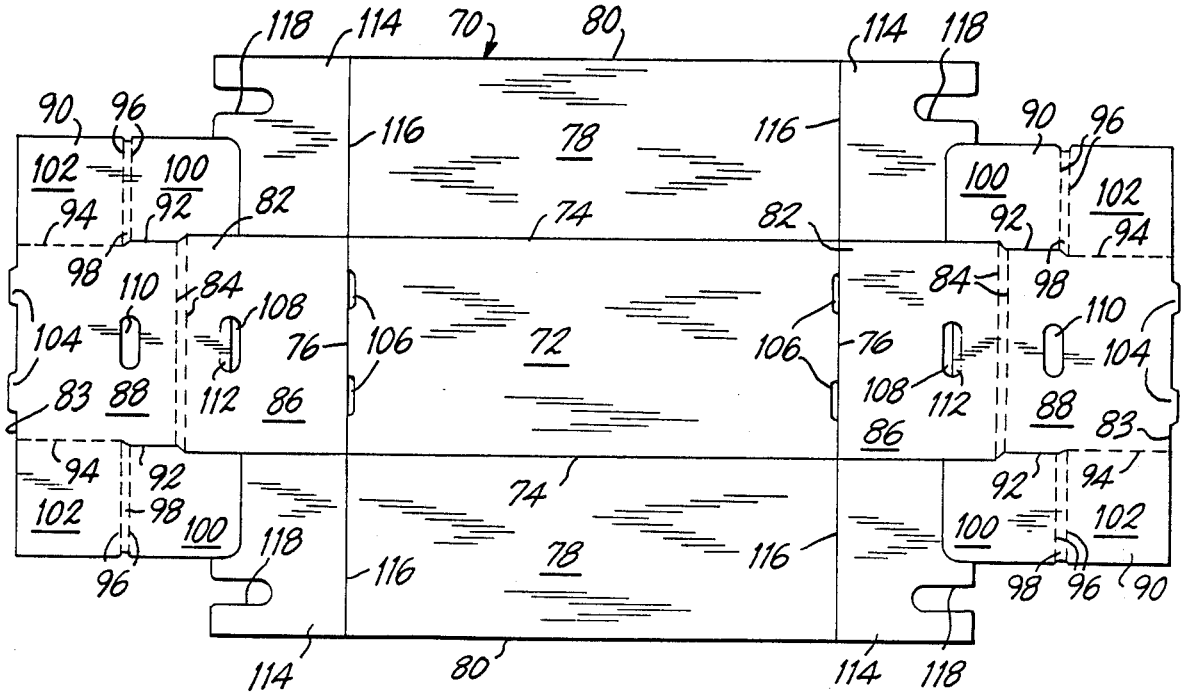
FIG. 3 is a plan view of a blank from which the container body is to be erected.
Figure 4:
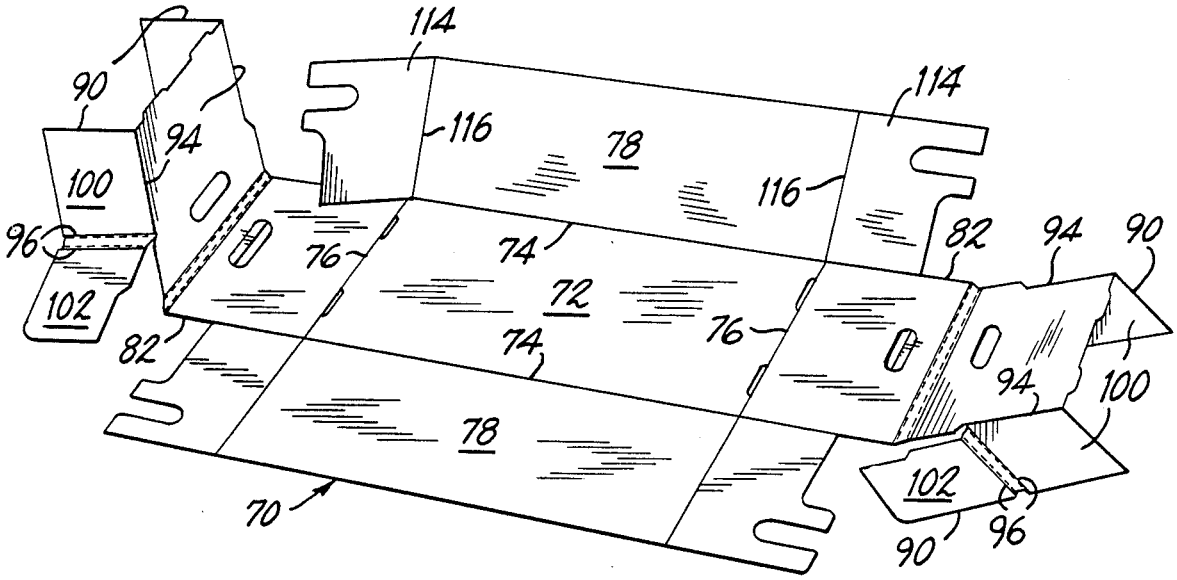
FIG. 4 is a perspective view of the blank in an initial stage of erection.
Figure 5:
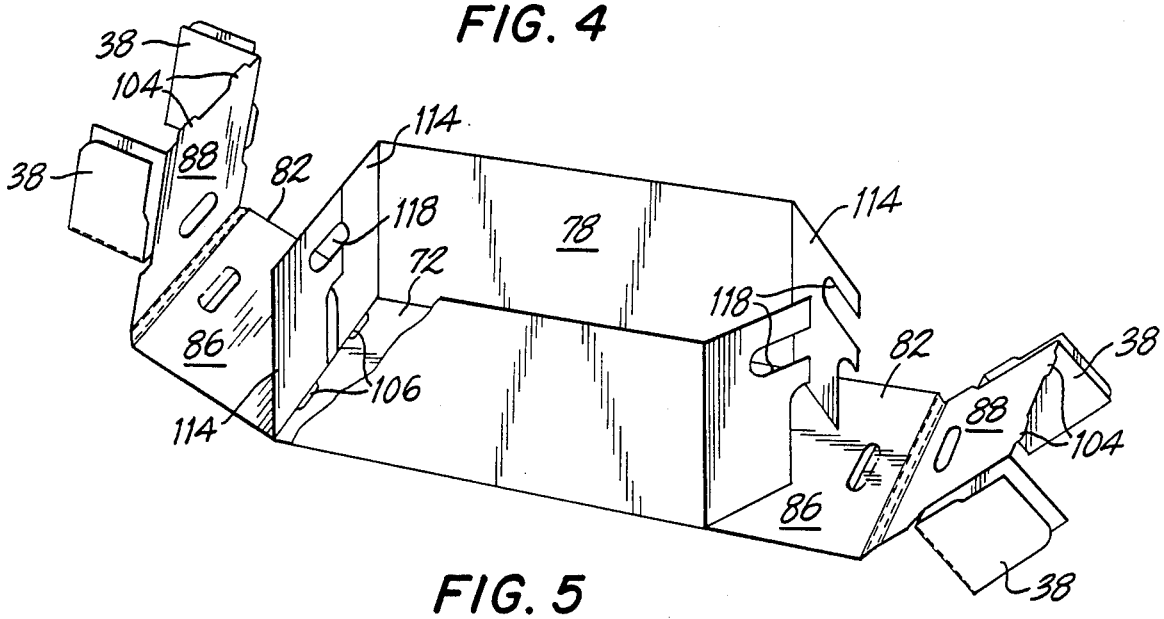
FIG. 5 is a perspective view of the blank in a further stage of erection.
Figure 6:
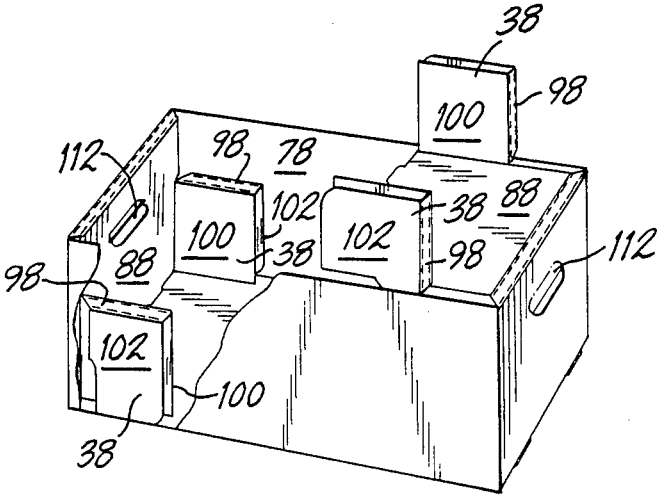
FIG. 6 is a perspective view of the blank in a still further stage of erection, with portions broken away for illustrative purposes.
Figure 7:
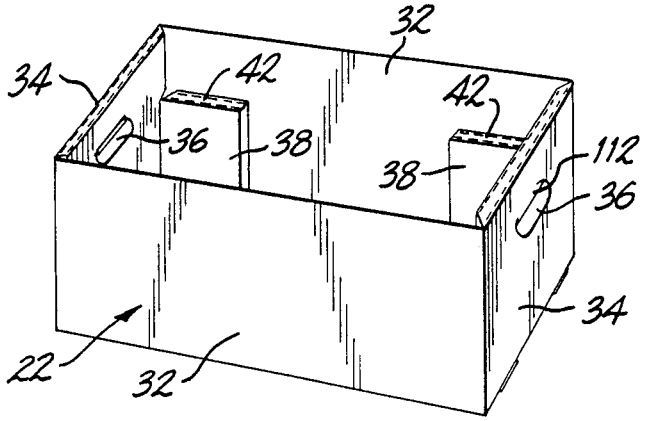
FIG. 7 is a perspective view of the blank, fully erected into the container body.

Turning now to FIG. 3, there is illustrated, in plan, a blank 70 from which the container body 22 is to be erected. Blank 70 is flat and is constructed of sheet material, such as corrugated paperboard. Blank 70 includes a bottom section 72 bounded by laterally opposite side fold-lines 74 and by longitudinally opposite end fold-lines 76. Side wall sections 78 extend between side fold-lines 74 and side boundary edges 80 of blank 70. End wall sections 82 extend between end fold lines 76 and end boundary edges 83 of blank 70. Each end wall section 82 is divided by end section fold-lines 84 into a first end wall portion 86 and a second end wall portion 88.

Cleat sections 90 are unitary with side edges 92 of each end wall section 82 along cleat section fold-lines 94 extending between the cleat sections 90 and the second end wall portions 88. Each cleat section 90 is divided by cleat portion fold-lines 96 and a support section 98 into a first cleat portion 100 and a second cleat portion 102. Locking tabs 104 are placed along the end boundary edges 83, and complementary locking slots 106 are placed in bottom section 72, adjacent end fold-lines 76, for purposes which will become apparent hereinafter. Openings 108 and 110, with flap 112, are provided in end wall portions 86 and 88 to establish the handhold apertures 36, as will be explained below. Side wall sections 78 carry end flaps 114 along end flap fold-lines 116, and each end flap 114 has a handhold clearance slot 118.

As illustrated in FIGS. 4 through 7, container body 22 is erected readily from flat blank 70. Side wall sections 78 are folded along fold-lines 74 to extend upwardly from bottom section 72 and end flaps 141 are folded toward one-another, along fold-lines 116. The cleat sections 90 are erected into the U-shaped configuration of cleats 38 by folding the cleat portions 100 and 102 along fold-lines 96 and the cleat sections 90 themselves are folded along fold-lines 94 to extend generally perpendicular to end wall sections 82.

The end wall sections 82 are folded along end fold-lines 76 to extend upwardly from the bottom section 72, and the second end wall portions 88 are folded along fold lines 84, over end flaps 114 and back into juxtaposition with first end wall portions 86, bringing cleats 38 into position along side wall sections 78 in an inverted U-shaped arrangement wherein the support section 98 of each cleat section 90 is supported by the first and second cleat portions 100 and 102. The locking tabs 104 are inserted into corresponding locking slots 106 to secure the second end wall portions 88 in place and the erection of container body 22 is complete. It is noted that the openings 108 and 110 are juxtaposed with one another and registered with clearance slots 118 to establish the handhold apertures 36. Flaps 112 may be inserted into the handhold apertures 36 for added gripping strength and comfort. Thus, it will be seen that the present invention provides a unitary flat blank 70 which is erected readily into container body 22 having unitary cleats 38 extending between the bottom 28 of the container body 22 and the horizontal ledges 48 upon which lie the support surfaces 42 which will receive the tray 24.

Figure 8:
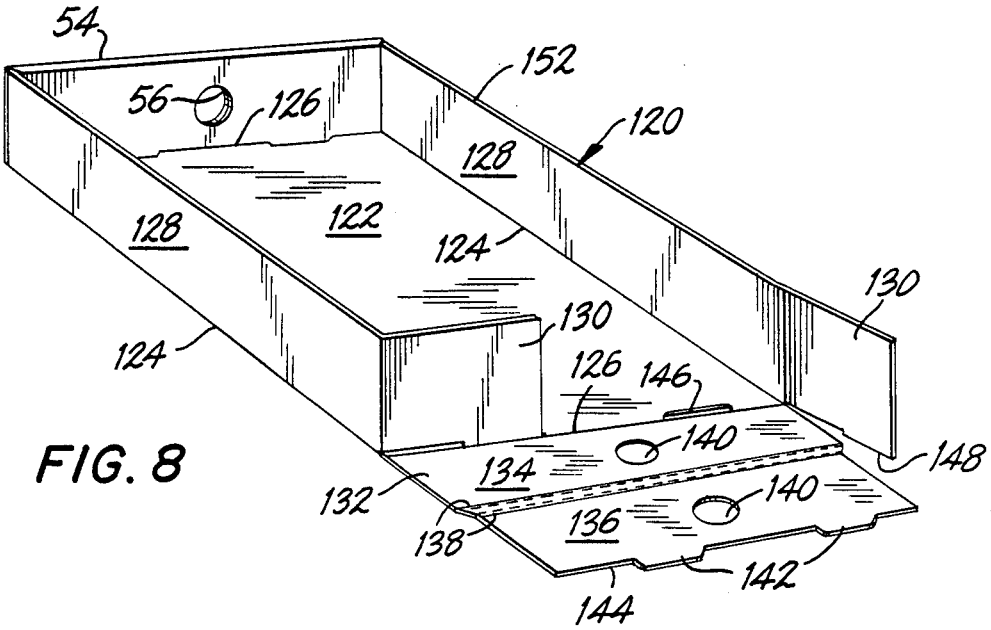
FIG. 8 is a perspective view of a tray blank, partially erected.

Referring now to FIG. 8, tray 24 likewise is erected from a flat blank, illustrated in the form of blank 120 which is shown partially erected. A bottom section 122 is bounded by side fold-lines 124 and end fold-lines 126. Side sections 128 are folded upwardly to establish side walls 52, and end flaps 130 are folded inwardly toward one another. End wall sections 132 are folded along fold-lines 126 and include end wall portions 134 and 136 which are folded about fold-lines 138, over end flaps 130, to establish end walls 54. Openings 140 in the end wall portions 134 and 136 are juxtaposed to establish finger-lift apertures 56 and locking tabs 142 along the outer edges 144 of end wall sections 132 are inserted into complementary locking slots 146 in bottom section 122. Added reinforcement is provided by locking tabs 148 on end flaps 130, which locking tabs 148 also are inserted into corresponding locking slots 146.

Figure 9:
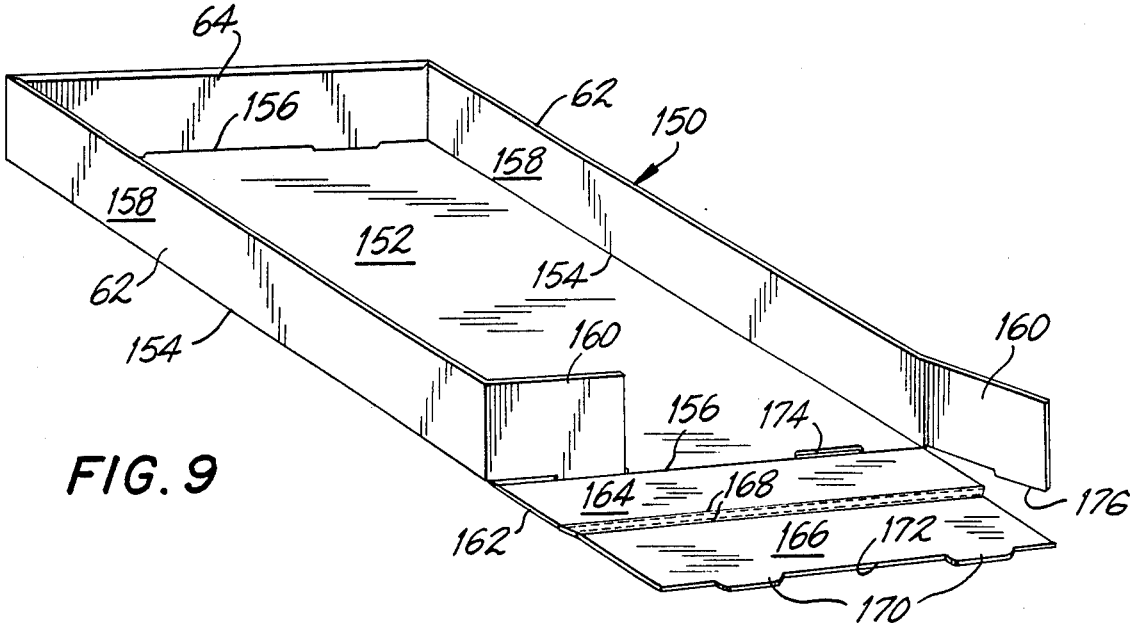
FIG. 9 is a perspective view of a cover blank, partially erected.

As seen in FIG. 9, cover 26 also is erected from a flat blank, shown in the form of partially-erected blank 150. The construction of cover 26 is very similar to that of tray 24. Thus, a top section 152 is bounded by side fold-lines 154 and end fold-lines 156. Side skirt sections 158 are folded about fold-lines 154 to establish side skirts 62, and end flaps 160 are folded inwardly toward one another. End skirt sections 162 are folded along fold-lines 156 and include end skirt portions 164 and 166 which are folded about fold-lines 168, over end flaps 160, to establish end skirts 64. Locking tabs 170 along outer edges 172 of end skirt sections 162 are inserted into complementary locking slots 174 in top section 152. Added reinforcement is provided by locking tabs 176 on end flaps 160, which locking tabs 176 also are inserted into corresponding locking slots 174.

Storage box 20 thus is erected from three flat blanks 70, 120 and 150, each of which is manufactured readily from relatively inexpensive sheet material. The three flat blanks easily are packaged and shipped and can be stored in flat configuration pending erection. When needed, a storage box 20, complete with tray 24 and cover 26, is erected with ease and simplicity.

Figure 10:
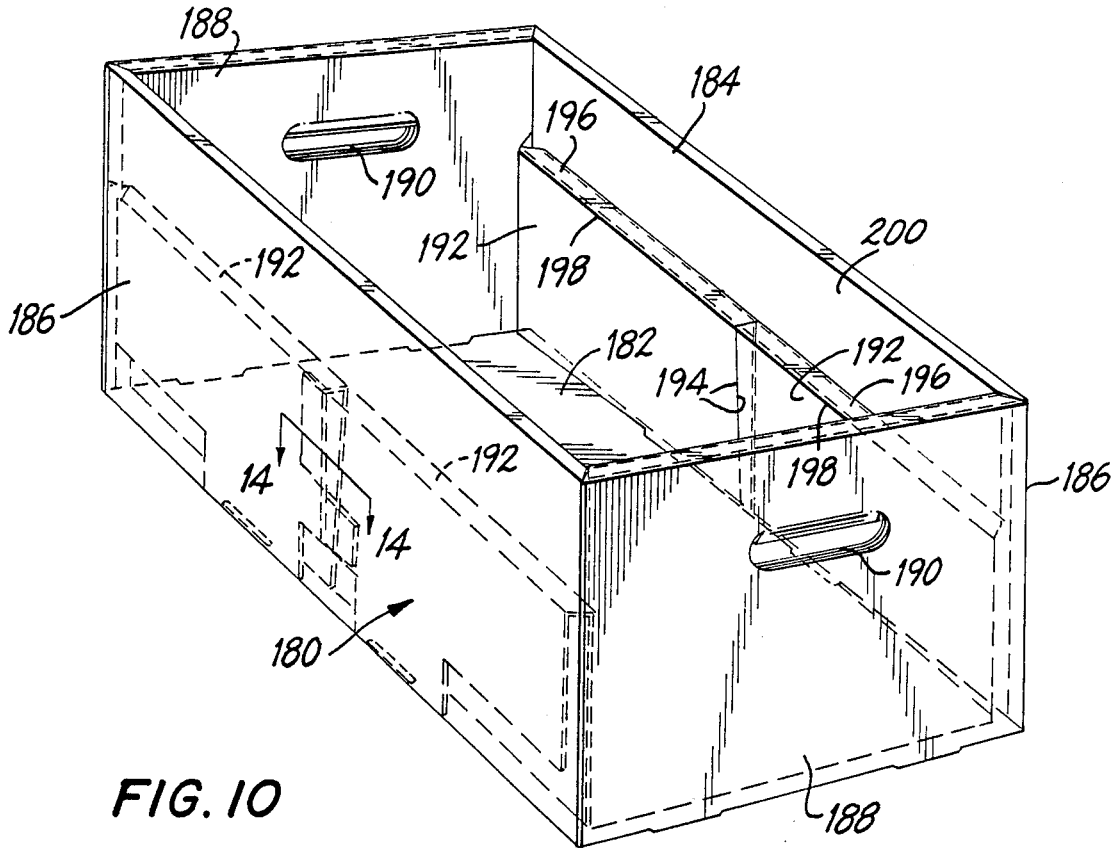
FIG. 10 is a perspective view of the container body of another embodiment of a storage box constructed in accordance with the invention.

Referring now to FIG. 10, another embodiment of the present invention utilizes a container body 180 constructed in accordance with the invention. Container body 180 is constructed in a manner similar to container body 22 described above; however, additional structural features are incorporated in order to provide even greater strength and rigidity. Thus, container body 180 has a closed bottom 182, an open top 184, side walls 186 and end walls 188 with handhold apertures 190. However, cleats 192 extend along the side walls 186 toward one another and actually engage one another at the confronting terminal ends 194 thereof. In this manner, the cleats 192 serve to reinforce the structure of container body 180 while also providing extended horizontal support surfaces 196 along ledges 198 extending from one end wall 188 to the other. In addition, the side walls 186 each are reinforced with an inner brace 200 extending along the side walls 186, between the end walls 188, above the cleats 192.

Figure 11:
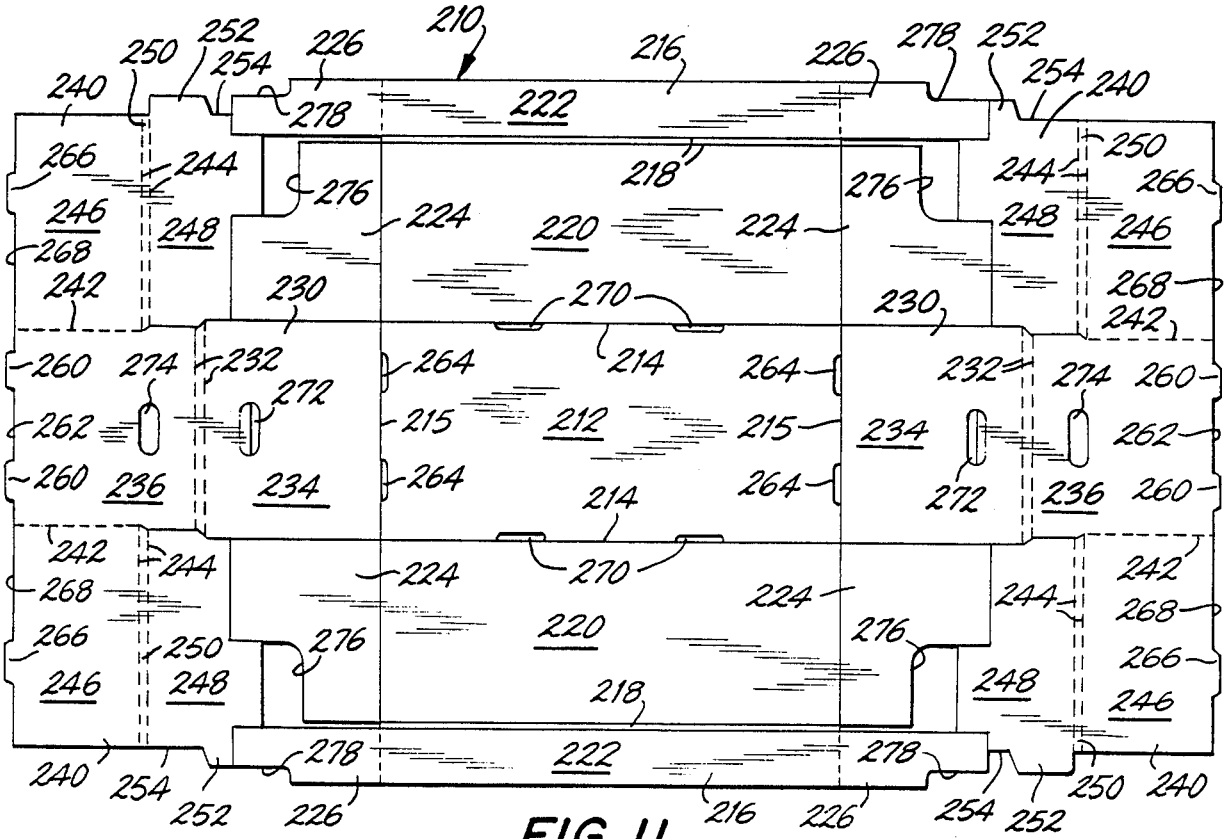
FIG. 11 is a plan view of a blank from which the container body of FIG. 10 is to be erected.

Turning to FIG. 11, there is illustrated, in plan, a blank 215 from which the container body 180 is to be erected. A bottom section 212 is bounded by side fold-lines 214 and end fold-lines 215. Side wall sections 216 are divided by further fold-lines 218 into first side portions 220 and second side portions 222. First end flaps 224 are carried by first side portions 220 and second end flaps 226 are carried by second side portions 222. End wall sections 230 are divided by fold-lines 232 into first portions 234 and second portions 236. The end wall sections 230 carry cleat sections 240 which are unitary with the end wall sections 230 along fold-lines 242. The cleat sections 240 are divided by fold-lines 244 into first portions 246 and second portions 248, with a support portion 250 between corresponding first and second cleat portions 246 and 248. Tongues 252 project outwardly from side edges 254 of the second cleat portions 248. As in the earlier-described embodiment, locking tabs 260 are provided along the outer edges 262 of second end portions 236 and corresponding locking slots 264 are placed in bottom section 212. However, in the present embodiment, additional locking tabs 266 are located along outer edges 268 of first cleat portions 246 and corresponding locking slots 270 are provided in bottom section 212, along side fold-lines 214, for purposes to be described below. Openings 272 and 274 are provided for the handhold apertures 190 and clearance recesses 276 and 278 are provided in first and second end flaps 224 and 226, respectfully.

Figure 12:
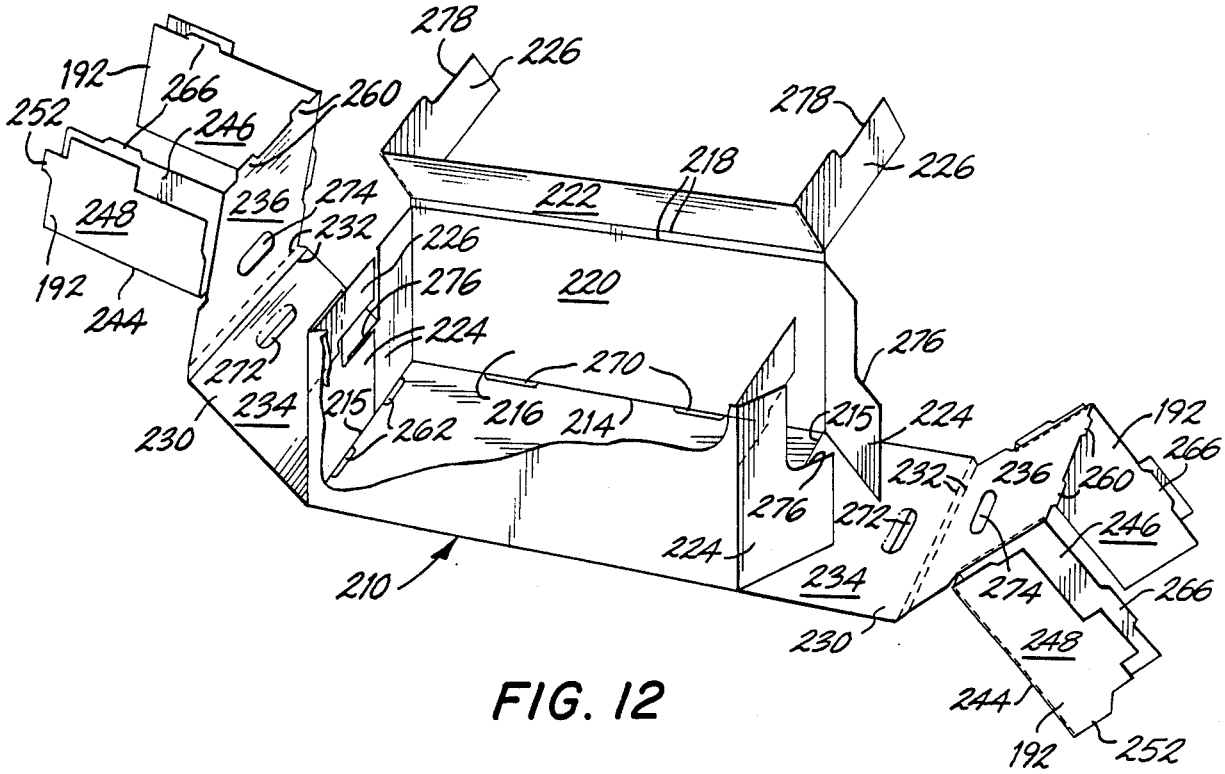
FIG. 12 is a perspective view of the blank of FIG. 10 partially erected.
Figure 13:
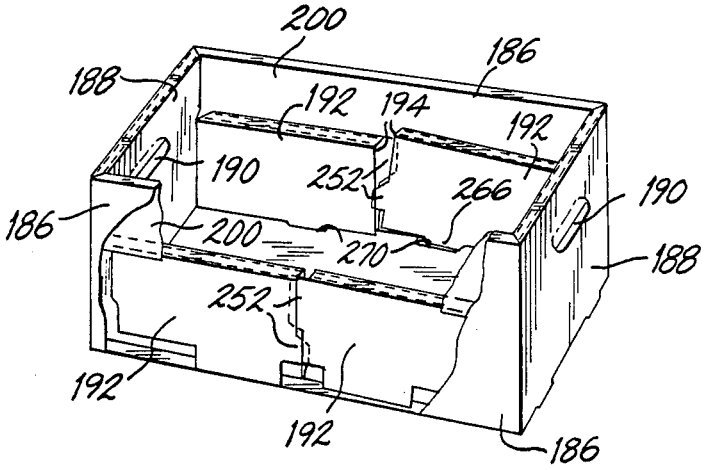
FIG. 13 is a perspective view of the blank of FIG. 10 fully erected, with portions broken away for illustrative purposes.
Figure 14:
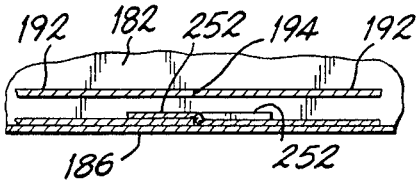
FIG. 14 is an enlarged fragmentary cross-sectional view taken along line 14—14 of FIG. 10.

As seen in FIGS. 12 through 14, blank 210 is erected into container body 180 by folding the various sections and portions in a manner similar to the earlier-described embodiment. Thus, side wall sections 216 are folded along fold-lines 214 and first end flaps 224 are folded inwardly toward one another. Second end flaps 226 are folded outwardly and then second side portions 222 are folded inwardly about fold-lines 218 until second side portions 222 are juxtaposed with first side portions 220 and second end flaps 226 extend inwardly toward one another along first end flaps 224. Then, cleat portions 246 and 248 are folded along fold-lines 244 to erect cleats 192, end wall sections 230 are folded upwardly about end fold-lines 215 and end wall portions 234 and 236 are folded about fold-lines 232 such that first end flaps 224 and second end flaps 226 are captured between juxtaposed end wall portions 234 and 236 and locking tabs 260 are inserted into corresponding locking slots 264 to secure end wall sections 230 in place, thereby establishing erected side walls 186 and erected end walls 188, with inner brace 200 extending along the side walls 186, between the end walls 188.

At the same time, cleats 192 are placed along the erected side walls 186, with the corresponding ends 194 of the cleats 192 confronting one another in abutting relationship. Locking tabs 266 are inserted into locking slots 270 and tongues 252 of each cleat 192 slide into the corresponding confronting cleat 192, as shown in FIGS. 13 and 14, further to lock the cleats 192 in place and add reinforcement and rigidity to the erected container body 180. Openings 272 and 274 are juxtaposed with one another and recesses 276 and 278 are registered with the juxtaposed openings 272 and 274 to establish handhold apertures 190. Thus, container body 180 is erected from a flat, single, unitary blank and together with flat blanks for tray 24 and cover 26 enables the ready manufacture, packaging, shipping and storage in inventory of a storage box of the type having a tray and cover.

It is to be understood that the above detailed description of the embodiments of the invention is provided by way of example only. Various details of design and construction may be modified without departing from the true spirit and scope of the invention as set forth in the appended claims.

The embodiments of the invention in which an exclusive property or privilege is claimed are defined as follows:

1. In a storage box of the type having a container body with a closed bottom, an open top, opposite longitudinally-extending side walls and opposite laterally-extending end walls, the end walls intersecting with the side walls at intersections between corresponding end walls and side walls, the side walls and the end walls extending upwardly from the closed bottom to the open top, and a removable tray supported upon support surfaces located on cleats placed wtihin the container body between the bottom and the top thereof, the improvement in which the container body is erected from a blank of sheet material, such as corrugated paperboard, the blank having longitudially opposite end boundaries and laterally opposite side boundaries, the blank comprising:

a bottom section bounded by laterally opposite side fold-lines and longitudinally opposite end fold-lines;

opposite side sections between the side boundaries and the opposite side fold-lines for folding along the side fold-lines to establish the upwardly-extending opposite side walls;

opposite end sections between the end boundaries and the opposite end fold-lines for folding along the end fold-lines to establish the upwardly-extending opposite end walls, the end sections each having side edges for juxtaposition with corresponding side walls upon erection of the side walls and the end walls;

cleat sections at the side edges of the end sections for establishing the cleats and placing the cleats in positions wherein the cleats extend longitudinally along corresponding side walls upon erection of the side walls, the end walls and the cleats; and a support surface position in each cleat section for establishing a corresponding support surface and placing the support surface in position wherein the support surface extends longitudinally along a corresponding side wall from the intersection of that side wall with a corresponding end wall toward the opposite end wall, the support surfaces being located between the closed bottom and the open top for supporting the tray thereon, upon erection of the container body;

the tray having a longitudinal length less than the longitudinal distance between the opposite end walls of the container body and each support portion having a longitudinal length greater than the difference between the length of the tray and the distance between the opposite end walls such that the tray selectively may be displaced in longitudinal directions relative to the end walls while supported upon all of the support surfaces of the erected cleats in the erected container body.

2. The invention of claim 1 wherein the cleat sections are unitary with corresponding end sections, the blank including cleat section fold-lines along the side edges of the end sections.

3. The invention of claim 2 wherein the blank is flat and unitary.

4. The invention of claim 1 wherein the longitudial length of the cleat sections is such that upon erection of the container body those cleats which are opposite one another and extend along the same side wall will engage one another.

5. The invention of claim 1 wherein the opposite side sections include first and second side portions and longitudinally-extending side portion fold-lines placed between the first and second side portions such that each first side portion extends between the corresponding side section fold-line and the corresponding side portion fold-line, and each second side portion extends between the side portion fold-line and the corresponding side boundary of the blank, whereby the first and second side portions are folded into juxtaposition with one another, along the side portion fold-lines, upon erection of the container body.

6. In a storage box of the type having a container body with a closed bottom, an open top, opposite longitudinally-extending side walls and opposite laterally-extending end walls, the end walls intersecting with the side walls at intersections between corresponding end walls and side walls, the side walls and the end walls extending upwardly from the closed bottom to the open top, and a removable tray supported upon support surfaces located on cleats placed within the container body between the bottom and the top thereof, the improvement in which the container body is erected from a blank of sheet material, such as corrugated paperboard, the blank having longitudinally opposite end boundaries and laterally opposite side boundaries, the blank comprising:

a bottom section bounded by laterally opposite side fold-lines and longitudinally opposite end fold-lines;

opposite side sections between the side boundaries and the opposite side fold-lines for folding along the side fold-lines to establish the upwardly-extending opposite side walls;

opposite end sections between the end boundaries and the opposite end fold-lines for folding along the end fold-lines to establish the upwardly-extending opposite end walls, the end sections each having side edges for juxtaposition with corresponding side walls upon erection of the side walls and the end walls;

cleat sections at the side edges of the end sections for establishing the cleats and placing the cleats in positions wherein the cleats extend longitudinally along corresponding side walls upon erection of the side walls, the end walls and the cleats; and a support surface portion in each cleat section for establishing a corresponding support surface and placing the support surface in position wherein the support surface extends longitudinally along a corresponding side wall from the intersection of that side wall with a corresponding end wall toward the opposite end wall, the support surfaces being located between the closed bottom and the open top for supporting the tray thereon, upon erection of the container body;

each cleat section including first and second cleat portions, the corresponding support surface portion being placed between the first and second cleat portions of each cleat section, each support surface portion intersecting with a corresponding cleat section at an intersection between the support surface portion and the corresponding cleat section, and a cleat portion fold-line extending along the intersection between the corresponding support surface portion and each corresponding cleat portion such that upon the erection of the cleats, the support surface portions provide the support surfaces and the first and second cleat portions are folded along corresponding cleat portion fold-lines to extend downwardly from the support surface portion to the closed bottom of the erected container body.

7. The invention of claim 6 including complementary locking means along at least one of the first and second cleat portions of each cleat section and along the bottom section for engagement upon erection of the container body to secure each erected cleat in place along the corresponding side wall within the erected container body.

8. The invention of claim 7 wherein the locking means include locking tabs on the said cleat portions and corresponding complementary locking slots in the bottom section.

9. The invention of claim 6 wherein the cleat sections are unitary with corresponding end sections, the blank including cleat section fold-lines along the side edges of the end sections.

10. The invention of claim 7 wherein the blank is flat and unitary.

11. The invention of claim 6 wherein the tray has a longitudinal length less than the longitudinal distance between the opposite end walls such that the tray selectively may be displaced in longitudinal directions relative to the end walls while supported upon all of the support surfaces of the erected cleats in the erected container body.

12. The invention of claim 11 wherein the longitudinal length of the cleat sections is such that upon erection of the container body those cleats which are opposite one another and extend along the same side wall will engage one another.

13. The invention of claim 12 including complementary interengaging means on the cleat sections for interengaging upon engagement of the erected cleats in the erected container body.

14. The invention of claim 13 wherein the cleat sections are unitary with corresponding end sections, the blank including cleat section fold-lines along the side edges of the end sections.

15. The invention of claim 14 wherein the blank is flat and unitary.

16. In a storage box of the type having a container body with a closed bottom, an open top, opposite longitudinally-extending side walls and opposite laterally-extending end walls, the end walls intersecting with the side walls at intersections between corresponding end walls and side walls, the side walls and the end walls extending upwardly from the closed bottom to the open top, and a removable tray supported upon support surfaces located on cleats placed within the container body between the bottom and the top thereof, the improvement in which the container body is erected from a blank of sheet material, such as corrugated paperboard, the blank having longitudinally opposite end boundaries and laterally opposite side boundaries, the blank comprising:

a bottom section bounded by laterally opposite side fold-lines and longitudinally opposite end fold-lines;

opposite side sections between the side boundaries and the opposite side fold-lines for folding along the side fold-lines to establish the upwardly-extending opposite side walls;

opposite end sections between the end boundaries and the opposite end fold-lines for folding along the end fold-lines to establish the upwardly-extending opposite end walls, the end sections having side edges for juxtaposition with corresponding side walls upon erection of the side walls and the end walls;

cleat sections at the side edges of the end sections for establishing the cleats and placing the cleats in positions wherein the cleats extend longitudinally along corresponding side walls upon erection of the side walls, the end walls and the cleats; and a support surface portion in each cleat section for establishing a corresponding support surface and placing the support surface in position wherein the support surface extends longitudinally along a corresponding side wall from the intersection of that side wall with a corresponding end wall toward the opposite end wall, the support surfaces being located between the closed bottom and the open top for supporting the tray thereon, upon erection of the container body;

the opposite end sections including first and second end portions and laterally-extending end section fold-lines placed between the first and second end portions such that upon erection of the end walls the first and second end portions are folded along the end section fold-lines into juxtaposition with one-another, each first end portion extending between the corresponding end fold-line and the corresponding end section fold-line and each second end portion extending between the corresponding end section fold-line and the corresponding end boundary of the blank, the cleat sections being integral with corresponding second end portions of the opposite end sections; and each cleat section including first and second cleat portions, the corresponding support surface portion being placed between the first and second cleat portions of each cleat section, and a cleat portion fold-line extending along the intersection betewen the support surface portion and each cleat portion such that upon the erection of the cleats, the support surface portions provide the support surfaces and the first and second cleat portions are folded along corresponding cleat portion fold-lines to extend downwardly from the support surface portion to the closed bottom of the erected container body.

17. The invention of claim 16 wherein the tray has a longitudinal length less than the longitudinal distance between the opposite end walls of the container body and each support portion has a longitudinal length greater than the difference between the length of the tray and the distance between the opposite end walls such that the tray selectively may be displaced in longitudinal directions relative to the end walls while supported upon all of the support surfaces of the erected cleats in the erected container body.

18. The invention of claim 17 wherein the longitudinal length of the cleat sections is such that upon erection of the container body opposed cleats extending along the same side wall will engage one another.

19. The invention of claim 18 wherein the cleat sections are unitary with corresponding end sections, the blank including cleat section fold-lines along the side edges of the end sections.

20. The invention of claim 19 wherein the blank is flat and unitary.

21. The invention of claim 16 wherein the opposite side sections include first and second side portions and longitudinally-extending side portion fold-lines placed between the first and second side portions such that each first side portion extends between the corresponding side section fold-line and the corresponding side portion fold-line, and each second side portion extends between the side portion fold-line and the corresponding side boundary of the blank, whereby the first and second side portions are folded into juxtaposition with one another, along the side portion fold-lines, upon erection of the container body.

22. The invention of claim 21 including end flaps at the opposite ends of the second side portions, and end flap fold-lines between the end tabs and the second side portions for enabling folding of the end flaps into juxtaposition with the end walls in the erected container body.

23. The invention of claim 22 wherein the end flaps extend between the first and second end portions of the end sections in the erected container body.

* * * * *